United States Patent [19]

Aida et al.

[11] 4,291,252

[45] Sep. 22, 1981

[54] ELECTRON TUBE CATHODE

[75] Inventors: Toshiyuki Aida, Chofu; Shigehiko Yamamoto, Tokorozawa; Sadanori Taguchi, Tokyo; Isamu Yuito, Ome; Yukio Honda, Fuchu; Ushio Kawabe, Tokyo; Akira Misumi, Mobara; Takao Kawamura; Hiroshi Fukushima, both of Chiba; Yoshio Degawa, Mobara, all of Japan

[73] Assignee: Hitachi, Ltd., Tokyo, Japan

[21] Appl. No.: 95,933

[22] Filed: Nov. 20, 1979

[30] Foreign Application Priority Data

Nov. 29, 1978 [JP] Japan ..... 53-146488

[51] Int. Cl.[3] ..... H01J 1/14; H01J 19/06; H01K 1/04

[52] U.S. Cl. ..... 313/346 R

[58] Field of Search ..... 313/337, 345, 346

[56] References Cited

U.S. PATENT DOCUMENTS

| | | | |
|---|---|---|---|
| 3,444,416 | 5/1969 | Yoshida et al. | 313/337 X |
| 3,553,521 | 1/1971 | Bakker et al. | 313/337 |
| 3,580,739 | 5/1971 | Hofmann et al. | 313/345 |
| 3,691,421 | 9/1972 | Decker et al. | 313/337 |
| 3,745,403 | 7/1973 | Misumi | 313/345 |
| 4,019,081 | 4/1977 | Buxbaum et al. | 313/346 R |
| 4,137,476 | 1/1979 | Ishii et al. | 313/346 R |
| 4,208,208 | 6/1980 | Misumi et al. | 313/346 R |

*Primary Examiner*—Saxfield Chatmon, Jr.
*Attorney, Agent, or Firm*—Craig and Antonelli

[57] ABSTRACT

An electron tube cathode has a composite suppression layer structure interposed between the base metal and the electron-emitting material to suppress an interface layer formed through the reaction of the base metal with the electron emissive material. The composite layer structure includes a thin layer of Pt or Re and a layer of oxide of Zr and/or Hf. As a result, the formation of the interface layer is prevented so that the useful life of the electron tube cathode is prolonged.

8 Claims, 5 Drawing Figures

ELECTRON TUBE CATHODE

Figure 1A:
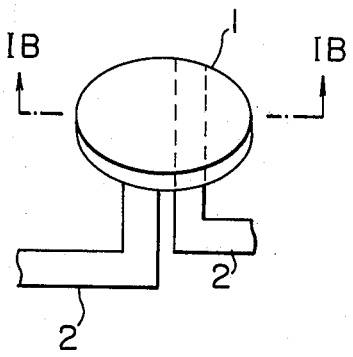

This invention relates to an electron tube cathode for use in a cathode ray tube for a TV receiver, and more particularly to an improvement on a directly heated type cathode having a short warmup time.

In general, cathodes are used in receiver tubes, discharge tubes, cathode ray tubes, etc. It is especially desired for the cathode used in the TV cathode ray tube to operate quickly for rapid display of images on the tube. This means that the cathode must have a short warmup time.

Cathodes are usually classified as being of the directly heated type or the indirectly heated type. The indirectly heated type cathode has a warmup time of about 20 seconds while the directly heated type cathode has a very short warmup time of 1 to 2 seconds. Accordingly, the directly heated type cathode is most preferable for prompt operation.

In order to render the warmup time as short as possible, a base metal of the directly heated cathode subjected to direct heating by an electric current must have a heat capacity which is as small as possible. However, if the thickness of the base metal is reduced to reduce the heat capacity, there will arise the following problems that since the content of a reducing impurity originally contained in a small amount in the base metal is further decreased, the emission life of the cathode is shortened, and that since the mechanical strength of the base metal at high temperatures is decreased, the thermal stress created through the reaction of the base metal with oxides forming the electron emissive material cannot be released, thereby causing thermal deformation and further deteriorating the white balance between the three guns producing R, G and B colors in the case of a color TV receiver.

In order to eliminate these problems, a cathode base metal has been proposed which is made of Ni alloy containing 0.3–0.5% by weight of Zr or Hf as a reducing impurity having a high diffusion rate and 20–28% by weight of W solved up to its solubility limit to obtain sufficient mechanical strength at high temperatures and suitable electric resistivity. However, although such a base metal has excellent mechanical and electrical properties, it is not preferable for practical use since it has an unstable emission characteristic. Namely, since the base metal has a composition including Ni, 20–28% by weight of W and 0.5% by weight of Zr or Hf, the contents of W and Zr or Hf are both considerable in comparison with the conventional composition (Ni, 2–4% by weight of W and 0.05% by weight of Zr of Hf). Therefore a W interface layer (a product formed through the reaction of alkaline earth metal oxides with tungsten oxide formed in the interface between the base metal and the alkaline earth metal oxide coating) and a Zr or Hf interface layer, which need not be taken into consideration in the case of conventional cathodes, thicken considerably in various heat treatment steps in the process of assembling cathode ray tubes. These interface layers are the cause of the peeling of the alkaline earth metal oxide coating which produces an uneven emission characteristic so that the resultant base metal has a poor reliability.

In the assembling process, there are indispensable heating steps such as (1) a sealing step for fixedly mounting electron guns in a glass envelope (in this step, the base metal is heated at 400°–600° C. for several minutes in the atmosphere) and (2) a carbonate resolving step for resolving carbonate applied on the surface of the base metal (in this step, the base metal is heated at 600°–900° C. in an atmosphere of $CO_2$ kept at a pressure of more than $10^{-3}$ Torr). As a result, the oxidation of the base metal surface is inevitable and hence the above-described interface layers are necessarily formed. On the other hand, the amount of solved W and the content of Zr (or Hf) cannot be decreased since they must be present in sufficient quantity to provide preferable mechanical and electrical properties for the base metal. Therefore, some means is strongly desired for suppressing the formation of the interface layers without decreasing the amount and content of these materials.

An object of this invention is to provide an electron tube cathode in which the formation of the W interface layer and the Zr or Hf interface layer can be suppressed without decreasing the amount of the solved W and the content of Zr or Hf and which has a high brightness, long life and stable emission characteristic.

According to this invention, there is provided an electron tube cathode comprising a base metal of Ni alloy containing W solved therein up to its solubility limit and a small amount of reducing impurity, a layer of oxide of metal provided on said base metal including at least one selected from a group consisting of Zr and Hf, a thin layer of metal provided on said metal oxide layer including one selected from a group consisting of Pt and Re, and a coating of electron emissive material provided on said thin metal film including an alkaline earth metal oxide.

The provision of a composite layer structure of the $ZrO_2$ and/or $HfO_2$ layer and the Pt or Re layer on the surface of the base metal suppresses the formation of the W and Zr or Hf interface layers, so that an electron tube cathode free from the deterioration of emission characteristic and has a high brightness and long life can be obtained.

Figure 1B:
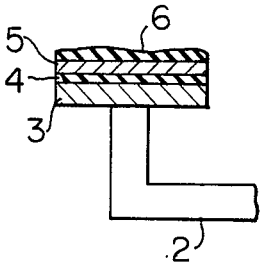
Figure 2:
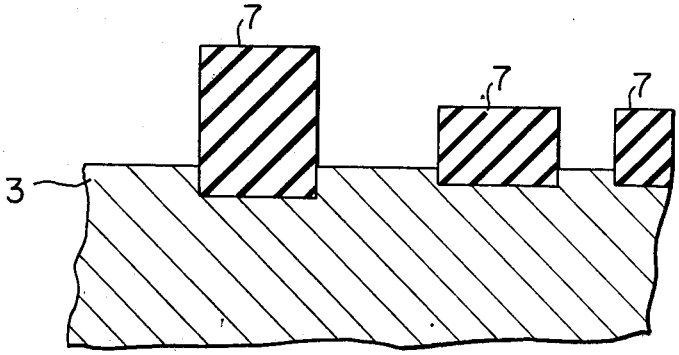
Figure 4:
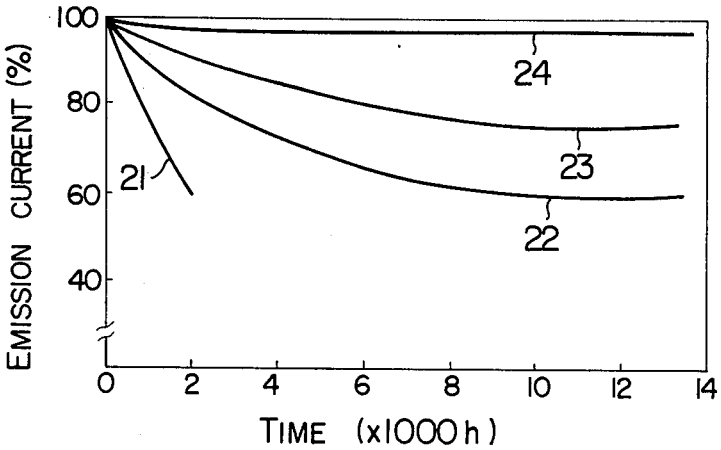
Figure 3:
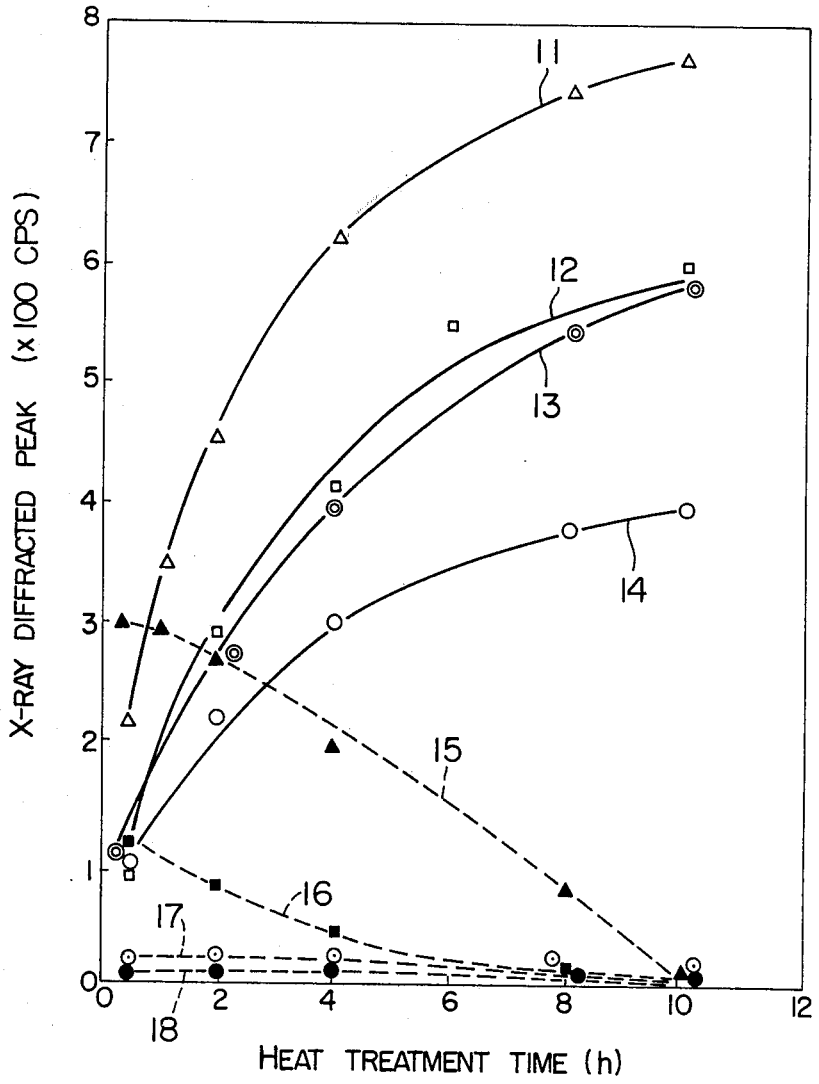

Now, this invention will be described with respect to preferred embodiments in conjunction with the accompanying drawings, in which:

FIG. 1A perspectively shows an electron tube cathode according to an embodiment of this invention;

FIG. 1B is a cross section taken along line IB—IB in FIG. 1;

FIG. 2 schematically shows the distribution of $ZrO_2$ on the surface of the base metal of the electron tube cathode according to this invention; and FIGS. 3 and 4 graphically show the effects obtained according to this invention.

Referring to FIG. 1A showing an electron tube cathode according to an embodiment of this invention and FIG. 1B showing a cross section taken along line IB in FIG. 1A, reference numeral 1 designates a cathode top face, 2 current leads, 3 a base metal containing Ni, 28% by weight of W and 0.4% by weight of Zr, 4 a layer of $ZrO_2$, 5 a layer of Pt, and 6 a layer of alkaline earth metal oxide. Namely, whereas the alkaline earth metal oxide layer 6 is directly deposited on the base metal 3 in the conventional cathode structure, the composite layer structure of the $ZrO_2$ layer 4 and the Pt layer 5 is interposed between the base metal 3 and the alkaline earth metal oxide layer 6 in accordance with this invention. The composite layer structure interposed prevents the reaction of the base metal 3 with the alkaline earth metal oxide layer 6 so that the formation of the W interface layer and the Zr interface layer is suppressed.

Although the $ZrO_2$ layer 4 may be formed by sputtering, it is most easily and best formed by the oxidation under reduced pressure (i.e. a method according to which an object is oxidized by heating in vacuum containing a predetermined amount of $H_2O$). For example, $H_2O$ having a partial pressure of about $10^{-5}$ Torr is introduced into a vacuum furnace in which the base metal 3 containing Zr is placed and the base metal 3 is subjected to a heat treatment at 1000° C. for 15 minutes so that a $ZrO_2$ layer 4 having a thickness of about 1000 Å is formed on the base metal 3. The thus formed $ZrO_2$ layer 4 has such a surface condition as shown in FIG. 2, fine particles 7 of $ZrO_2$ being dispersed on the surface of the base metal 3. By changing the conditions in the reduced oxidation, i.e. temperature, time and amount of $H_2O$, the particles 7 of $ZrO_2$ may be formed only in the grain boundaries of the base metal 3 or in both the grains and the grain boundaries of the base metal 3. In any case, the $ZrO_2$ layer 4 should be formed in such a manner that the fine particles of $ZrO_2$ do not completely cover the surface of the base metal 3. For, if the particles 7 of $ZrO_2$, which is an insulating material, completely cover the surface of the base metal 3, the alkaline earth metal oxide layer 6 is electrically isolated from the base metal 3 so that the electron emitting ability is killed.

It is therefore most preferable that the particles of $ZrO_2$ should be moderately formed in both the grains and the grain boundaries of the base metal 3. In this case, a somewhat different type of definition of thickness is introduced; the thickness of the $ZrO_2$ layer 7 is defined as the thickness of the layer to be formed if all the particles of $ZrO_2$ strewn in and on the base metal 3 are rearranged uniformly on the surface of the base metal 3. This thickness should preferably be set within a range of 100–10000 Å. For the $ZrO_2$ layer having the above defined thickness of smaller than 100 Å is too thin to effectively suppress the formation of the interface layers while the $ZrO_2$ layer of a thickness greater than 10000 Å is thick enough to completely cover the surface of the base metal, killing the electron emitting ability.

The function of the $ZrO_2$ layer 4 is to suppress the diffusion rate of the Zr atoms contained in the base metal 3 diffusing into the alkaline earth metal layer 6. Namely, since the $ZrO_2$ particles 7 are formed mainly along the grain boundaries of the base metal 3, as described above, the $ZrO_2$ particles 7 after the formation of the $ZrO_2$ layer 4 serve as barriers against the diffusion of Zr atoms tending to diffuse along the grain boundaries. Accordingly, the wasteful consumption of Zr atoms can be prevented and therefore the formation of a Zr interface layer of, for example, $BaZrO_3$ can also be suppressed. However, the present inventors's experiments have shown that the $ZrO_2$ layer 4 has a poor effect on the suppression of the formation of a W interface layer such as a $Ba_3WO_6$ layer. According to the embodiment of this invention, the Pt layer 5 deposited on the $ZrO_2$ layer 4 serves to suppress the W interface layer. The Pt layer 5 may be formed by vacuum evaporation or plating and should preferably have a thickness of 1000–2000 Å. For a thickness less than 1000 Å has no effect of suppressing the formation of the W interface layer and a thickness greater than 2000 Å enters the region of saturation in suppressing the formation of the W interface layer so that the further increase in the thickness provides no useful effect but incurs much useless expense since Pt is expensive material. Since the Pt layer 5 covers the surface of the base metal inclusive of the $ZrO_2$ particles 7, it can prevent the base metal 3 from being oxidized in the fabrication process of the cathode ray tube and moreover since the layer 5 is consumed through its diffusion into the base metal 3 during the actual TV operation, the layer 5 does not form a barrier against the diffusion of the reducing impurity so that a sufficient emission ability can be expected. Accordingly, the provision of the Pt layer 5 serves to suppress the oxidation of the surface of the base metal 3 so that the formation of WOx etc. can be suppressed. When the formation of WOx is suppressed, the formation of $Ba_3WO_6$ produced through the reaction of WOx with BaO can be suppressed. As to $Ba_3WO_6$, it produces $BaZrO_3$ through the subsequent reaction with Zr. As described, however, since the diffusion of Zr atoms is suppressed by the $ZrO_2$ layer 4, the formation of the final product $BaZrO_3$ is suppressed. With the mechanism described above, the formation of the W interface layer and the Zr interface layer can be effectively suppressed by the function of the composite layer structure including the $ZrO_2$ layer 4 and the Pt layer 5.

Next, the experimental results concerning the suppressing effects with and without the composite suppressing layer structure of the $ZrO_2$ layer 4 and the Pt layer 5 will be explained.

There was prepared a first sample of base metal having a composition Ni—28% by weight of W–0.4% by weight of Zr, subjected to annealing at 900° C. for 30 minutes in a vacuum furnace kept at $2\times10^{-6}$ Torr; a second sample of the same base metal with a $ZrO_2$ layer (forming conditions: 1000° C.×30 minutes, $1\times10^{-5}$ Torr $H_2O$) 1000 Å thick provided thereon; a third sample of the same base metal with a Pt layer 1500 Å thick provided thereon; and a fourth sample of the same base metal with a $ZrO_2$ layer 1000 Å thick and a Pt layer 1500 Å thick provided in this order on the base metal. Carbonates $(Ba_{0.5}Sr_{0.5}Ca_{0.5})CO_3$ of alkaline earth metals were applied to the surface of these samples serving as cathodes, by a spray method. The samples with the carbonate layers were subjected to a heat treatment at 1000° C. for 0.5–10 hours in vacuum and the amounts of the consequently formed interface layers were measured by X-ray diffraction. The X-ray conditions used were the Cu-K$\alpha$ line, the filter was of Ni, the applied voltage was 40 KV, and the passed current was 30 mA.

FIG. 3 shows graphically the relationship between the duration of the heat treatment and the amount of the formed interface layer. In FIG. 3, curves 11, 12, 13 and 14 correspond to the cases where the material of the interface layer is $BaZrO_3$, and curves 15, 16, 17 and 18 to the cases where the material is $Ba_3WO_6$. The curves 11 and 15 correspond to the cases where the suppressing layer is not provided, the curves 12 and 16 to the case where only a $ZrO_2$ layer serves as the suppressing layer, the curves 13 and 17 to the case where only a Pt layer is used as the suppressing layer, and the curves 14 and 18 correspond to the cases where a double layer of $ZrO_2$ and Pt is provided to serve as the suppressing layer according to one embodiment of this invention. It is to be noted in FIG. 3 that the amounts of the interface layers formed are expressed in terms of the X-ray diffracted peaks.

As apparent from FIG. 3, the amount of the formed W interface layer material ($Ba_3WO_6$) decreases with the time of heat treatment while the amount of the formed Zr interface layer material ($BaZrO_3$) increases with the time of heat treatment. This phenomenon is ascribed to the fact that the W interface layer undergoes metamorphosis with the passage of time and changes into the Zr interface layer. Also, the curve 16 shows that the $ZrO_2$ layer along has not an effect sufficient to suppress the formation of the W interface material. Therefore, as shown by the curves 14 and 18, the composite suppressing layer structure of the $ZrO_2$ and the Pt layers has an effect large enough to suppress both the W and Zr interface layers.

The useful life time of the electron tube cathode according to this invention will now be explained.

FIG. 4 graphically shows the result of the measurement of the change with time of the electron emission effectiveness with cathode ray tubes incorporating cathodes fabricated under the same conditions as in the fabrication of the samples used in the above-described experiment on the effect of suppressing the interface layers. In FIG. 4, curve 21 corresponds to the case where the base metal is an alloy having a composition Ni—28% by weight of W—0.4% by weight of Zr and no suppressing layer is provided, curve 22 to the case where the same base metal with a suppressing layer of $ZrO_2$ alone is used, curve 23 to the case where the same base metal with a suppressing layer of Pt alone is used, and curve 24 to the case where the same base metal with a composite suppressing layer of $ZrO_2$ and Pt is used according to one embodiment of this invention. The emission current measured along the ordinate is plotted against the time of operation while the brightness temperature of the alkaline earth metal oxide is kept at 730° C. and the values of the emission current is normalized with respect to the initial value set at 100%.

As apparent from FIG. 4, the emission characteristic of the electron tube cathode (depicted by the curve 24) using the base metal with a composite suppressing layer of $ZrO_2$ and Pt according to one embodiment of this invention is very much improved in comparison with the electron tube cathode (curve 21) using a conventional cathode base metal without a layer for suppressing the formation of an interface layer. This also means that the present cathode using a composite suppressing layer of $ZrO_2$ and Pt is by far superior to the electron tube cathode (curves 22 and 23) using a suppressing layer of $ZrO_2$ or Pt alone and that the provision of both the $ZrO_2$ and the Pt layers multiplies the suppressing effect.

In the fabrication of an ordinary electron tube cathode, powder of Ni (nickel carbonyl powder having chain structure) of several $mg/cm^2$ is applied by spraying onto the surface of the base metal so as to fix the alkaline earth metal oxide to the surface of the base metal. The Ni powder sometimes deteriorates during the operation of the cathode ray tube so that the oxide will peel. The cause of the peeling is due to the diffusion of Zr atoms from the base metal into the powder of Ni. However, by employing the cathode structure according to this invention, in which a $ZrO_2$ film is provided on the surface of a base metal, nickel powder is applied onto the $ZrO_2$ film, a Pt layer is formed on the Ni powder layer, and an alkaline earth metal oxide layer is finally provided, the diffusion of Zr atoms from the base metal can be prevented so that the deterioration of the Ni powder can be prevented, with the result that the peeling of the alkaline earth metal oxide can be prevented. Consequently, this leads to the prolongation of the useful life time of the cathode ray tube.

Although in the foregoing description, Zr is used as a reducing impurity, Hf or both Zr and Hf may be used as a reducing impurity so as to obtain the same effect. Also, the substitution of a Re layer for the Pt layer and a $HfO_2$ layer or a mixture layer of $ZrO_2$ and $HfO_2$ for the $ZrO_2$ layer will little change the expected result. It is also possible to replace the Ni powder by powder of Ni-W alloy. Further, in the foregoing description, the content of W in the base metal is 28% by weight, but it may be any value in the range of 20–28 weight %. For, when the content of W in the base metal is less than 20% by weight, the mechanical strength and the electrical resistivity of the base metal at high temperatures are both lowered while the content of W in excess of 28% by weight results in an intermetallic compound to make the characteristic non-uniform and therefore undesirable.

As described above, an electron tube cathode according to this invention can operate for a long time with little deterioration in the emission characteristic and the electron emissive material can be effectively prevented from peeling off.

What is claimed is:

1. An electron tube cathode comprising a base metal of Ni alloy containing W solved therein up to its solubility limit and a reducing impurity of small amount, a layer of an oxide of metal provided on said base metal including at least one material selected from a group consisting of Zr and Hf, a thin film of metal provided on said metal oxide layer including one selected from a group consisting of Pt and Re, and a coating of electron emissive material provided on said thin metal film including an alkaline earth metal oxide.

2. An electron tube cathode as claimed in claim 1, wherein the amount of W solved in said Ni alloy is 20 to 28% by weight.

3. An electron tube cathode as claimed in claim 1, wherein the thickness of said metal oxide layer is 100 to 10000 Å.

4. An electron tube cathode as claimed in claim 1, wherein the thickness of said thin metal film is 1000 to 2000 Å.

5. An electron tube cathode as claimed in claim 1, wherein said metal oxide layer is made of $ZrO_2$ or $HfO_2$.

6. An electron tube cathode as claimed in claim 1, wherein said thin metal film is made of Pt.

7. An electron tube cathode as claimed in claim 1, wherein said reducing impurity is at least one metal selected from a group consisting of Zr and Hf.

8. An electron tube cathode as claimed in claim 1, wherein a layer of fine powders of one selected from a group consisting of Ni and Ni-W alloy is provided between said metal oxide layer and said thin metal film.

* * * * *